US008790139B2

(12) United States Patent
Fitzpatrick

(10) Patent No.: US 8,790,139 B2
(45) Date of Patent: Jul. 29, 2014

(54) COMMUNICATIONS JACKS HAVING SLIDING CONTACTS AND/OR CONTACTS HAVING INSULATIVE BASE MEMBERS

(75) Inventor: Brian J. Fitzpatrick, McKinney, TX (US)

(73) Assignee: CommScope, Inc. of North Carolina, Hickory, NC (US)

( * ) Notice: Subject to any disclaimer, the term of this patent is extended or adjusted under 35 U.S.C. 154(b) by 127 days.

(21) Appl. No.: 13/530,157

(22) Filed: Jun. 22, 2012

(65) Prior Publication Data

US 2013/0344725 A1 Dec. 26, 2013

(51) Int. Cl.
*H01R 24/00* (2011.01)

(52) U.S. Cl.
USPC ..... 439/676; 439/700

(58) Field of Classification Search
USPC ..... 439/676, 76.1, 344, 189, 395, 700
See application file for complete search history.

(56) References Cited

U.S. PATENT DOCUMENTS 6,312,295 B2 * 11/2001 Nishimatsu ..... 439/700
6,524,140 B2 * 2/2003 Takagi et al. ..... 439/700
6,729,914 B2 * 5/2004 Jaouen ..... 439/676
6,786,776 B2 * 9/2004 Itano et al. ..... 439/676
7,427,218 B1 9/2008 Hashim et al.
7,503,810 B1 * 3/2009 Goodrich et al. ..... 439/676
7,837,153 B2 11/2010 Chesser et al.
7,857,635 B2 12/2010 Goodrich et al.
7,985,100 B2 * 7/2011 Jaouen et al. ..... 439/676
2002/0009930 A1 1/2002 Chang
2005/0202697 A1 * 9/2005 Caveney et al. ..... 439/77
2009/0068883 A1 3/2009 Goodrich et al.
2009/0081907 A1 * 3/2009 Shen et al. ..... 439/676
2012/0244752 A1 9/2012 Patel et al.

OTHER PUBLICATIONS

Notification of Transmittal of the International Search Report and the Written Opinion of the International Searching Authority, or the Declaration, PCT/US2013/044707, Sep. 16, 2013.

* cited by examiner

*Primary Examiner* — Phuongchi T Nguyen
(74) *Attorney, Agent, or Firm* — Myers Bigel Sibley & Sajovec, P.A.

(57) ABSTRACT

Communications jacks include a plurality of contacts that are configured to move between a resting position and a deflected position and at least one biasing member that is separate from the plurality of contacts that biases at least a first of the plurality of contacts towards its resting position. The jacks further include a printed circuit board that includes a first contact structure that is configured to electrically connect to the first of the plurality of contacts when the first of the plurality of contacts is in its deflected position.

18 Claims, 10 Drawing Sheets

COMMUNICATIONS JACKS HAVING SLIDING CONTACTS AND/OR CONTACTS HAVING INSULATIVE BASE MEMBERS

FIELD OF THE INVENTION

The present invention relates generally to communications connectors and, more particularly, to communications jacks.

BACKGROUND

Computers, fax machines, printers and other electronic devices are routinely connected by communications cables to network equipment such as routers, switches, servers and the like. FIG. 1 illustrates the manner in which a computer 10 may be connected to a network device 30 (e.g., a network switch) using conventional communications plug/jack connections. As shown in FIG. 1, the computer 10 is connected by a patch cord 11 to a communications jack 20 that is mounted in a wall plate 18. The patch cord 11 comprises a communications cable 12 that contains a plurality of individual conductors (e.g., eight insulated copper wires) and first and second communications plugs 13, 14 that are attached to the respective ends of the cable 12. The first communications plug 13 is inserted into a plug aperture of a communications jack (not shown) that is provided in the computer 10, and the second communications plug 14 is inserted into a plug aperture 22 in the front side of the communications jack 20. The contacts or "blades" of the second communications plug 14 are exposed through the slots 15 on the top and front surfaces of the second communications plug 14 and mate with respective "jackwire" contacts of the communications jack 20. The blades of the first communications plug 13 similarly mate with respective jackwire contacts of the communications jack (not shown) that is provided in the computer 10.

The communications jack 20 includes a back-end wire connection assembly 24 that receives and holds insulated conductors from a cable 26. As shown in FIG. 1, each conductor of cable 26 is individually pressed into a respective one of a plurality of slots provided in the back-end wire connection assembly 24 to establish mechanical and electrical connection between each conductor of cable 26 and a respective one of a plurality of conductive paths (not shown in FIG. 1) through the communications jack 20. The other end of each conductor in cable 26 may be connected to, for example, the network device 30. The wall plate 18 is typically mounted on a wall (not shown) of a room of, for example, an office building, and the cable 26 typically runs through conduits in the walls and/or ceilings of the office building to a room in which the network device 30 is located. The patch cord 11, the communications jack 20 and the cable 26 provide a plurality of signal transmission paths over which information signals may be communicated between the computer 10 and the network device 30. It will be appreciated that typically one or more patch panels, along with additional communications cabling, would be included in the communications path between the cable 26 and the network device 30. However, for ease of description, in FIG. 1 the cable 26 is shown as being directly connected to the network device 30.

In the above-described communications system, the information signals that are transmitted between the computer 10 and the network device 30 are typically transmitted over a pair of conductors (hereinafter a "differential pair" or simply a "pair") rather than over a single conductor. An information signal is transmitted over a differential pair by transmitting signals on each conductor of the pair that have equal magnitudes, but opposite phases, where the signals transmitted on the two conductors of the pair are selected such that the information signal is the voltage difference between the two transmitted signals. The use of differential signaling can greatly reduce the impact of noise on the information signal.

Various industry standards, such as the TIA/EIA-568-B.2-1 standard approved Jun. 20, 2002 by the Telecommunications Industry Association, have been promulgated that specify configurations, interfaces, performance levels and the like that help ensure that jacks, plugs and cables that are produced by different companies will all work together. By way of example, the TIA/EIA-568-B.2-1 standard is designed to ensure that plugs, jacks and cable segments that comply with the standard will provide certain minimum levels of performance for signals transmitted at frequencies of up to 250 MHz. Most of these industry standards specify that each jack, plug and cable segment in a communications system must include a total of eight conductors 1-8 that are arranged as four differential pairs of conductors. The industry standards specify that, in at least the connection region where the contacts (blades) of a plug mate with the jackwire contacts of the jack (referred to herein as the "plug-jack mating region"), the eight conductors are generally aligned in a row. As shown in FIG. 2, under the TIA/EIA 568 type B configuration (which is the most widely followed), conductors 4 and 5 comprise differential pair 1, conductors 1 and 2 comprise differential pair 2, conductors 3 and 6 comprise differential pair 3, and conductors 7 and 8 comprise differential pair 4.

Unfortunately, the industry-standardized configuration for the plug-jack mating region that is shown in FIG. 2, which was adopted many years ago, generates a type of noise known as "crosstalk." As is known to those of skill in this art, "crosstalk" refers to unwanted signal energy that is induced onto the conductors of a first "victim" differential pair from a signal that is transmitted over a second "disturbing" differential pair. Various techniques have been developed for cancelling out the crosstalk that arises in industry standardized plugs and jacks. Many of these techniques involve providing crosstalk compensation circuits in each communications jack that introduce "compensating" crosstalk that cancels out much of the "offending" crosstalk that is introduced in the plug and the plug-jack mating region due to the industry-standardized plug-jack interface. In order to achieve high levels of crosstalk cancellation, the industry standards specify pre-defined ranges for the crosstalk that is injected between the four differential pairs in each communication plug, which allows each manufacturer to design the crosstalk compensation circuits in their communications jacks to cancel out these pre-defined amounts of crosstalk. Typically, the communications jacks use "multi-stage" crosstalk compensation circuits as disclosed, for example, in U.S. Pat. No. 5,997,358 to Adriaenssens et al. (hereinafter "the '358 patent"), as multi-stage crosstalk compensating schemes can provide significantly improved crosstalk cancellation, particularly at higher frequencies. The entire contents of the '358 patent are hereby incorporated herein by reference as if set forth fully herein.

SUMMARY

Pursuant to embodiments of the present invention, communications jacks are provided that include a plurality of contacts that each include an electrically conductive contact surface. Each of the plurality of contacts is configured to move between a resting position and a deflected position. These jacks further include at least one biasing member that is separate from the plurality of contacts and that is electrically insulated from the conductive contact surfaces of the plurality of contacts. This at least one biasing member is configured to bias at least a first of the plurality of contacts towards its resting position. The jacks also include a printed circuit board that includes a first contact structure that is configured to electrically connect to the first of the plurality of contacts when the first of the plurality of contacts is in its deflected position.

In some embodiments, the first contact structure may be a first contact pad, and the first of the plurality of contacts may physically engage the first contact pad when the first of the plurality of contacts is in its deflected position. In some embodiments, each of the plurality of contacts may be a sliding contact that slides between its resting position and its deflected position. The jack may further include a housing that has a plug aperture, and the plurality of contacts may be located within this plug aperture. Each of the contacts may be implemented as an elongated insulative structure that has a conductive element that includes the conductive contact surface mounted thereon. The conductive element may be, for example, a resilient metal strip that is mounted on an end of the elongated insulative structure.

In some embodiments, the communications jack may be an RJ-45 jack that has eight contacts that are arranged as four differential pairs of contacts and that are each configured to slidably move along the top surface of the printed circuit board. In some embodiments, the at least one biasing member may be a plurality of springs that are each configured to bias a respective one of the plurality of contacts towards its resting position.

Pursuant to further embodiments of the present invention, RJ-45 jacks are provided that have a housing having a plug aperture that is sized to receive an RJ-45 plug. a printed circuit board, and first through eighth contacts that extend into the plug aperture and that are arranged as four differential pairs of contacts. Each of the first through eighth contacts is configured to slide from a respective resting position above the printed circuit board to a respective deflected position above the printed circuit board when the RJ-45 plug is received within the plug aperture.

In some embodiments, each of the first through eighth contacts may be implemented as an elongated insulative structure that has a conductive element mounted thereon. Each of the first through eighth contacts may be a spring-biased contact. The RJ-45 jack may also include a contact guide structure that includes a plurality of channels, where each of the first through eighth contacts are configured to slidably move within respective ones of the plurality of channels. The RJ-45 jack may also include a printed circuit board that has a plurality of contact pads mounted thereon, and each of the contact pads may be positioned to be under the conductive element of a respective one of the first through eighth contacts when the first through eighth contacts are in their deflected positions. The conductive element of at least one of the first through eighth contacts may extend along a portion of the bottom of the elongated insulative structure and around a front portion of the elongated insulative structure.

Pursuant to further embodiments of the present invention, contacts for an RJ-45 jack are provided that include an insulative member having a first end and a second end, an electrically conductive contact structure mounted at the first end of the insulative member, and a biasing member that biases the insulative member in a resting position. In some embodiments, the electrically conductive contact structure may comprise an elongated metal strip that is conformally mounted on the first end of the insulative member. The electrically conductive contact structure may be formed of a resilient metal and may be resiliently mounted on the first end of the insulative member. The contact may be one of a plurality of such contacts that are included in a communications jack that includes a printed circuit board. The contacts may each include a pad contact surface that is configured to mate with a surface contact pad that is provided on a top surface of the printed circuit board. The contacts may each be configured to slidably move from a resting position to a deflected position in response to a plug being inserted into a plug aperture of the communications jack.

DETAILED DESCRIPTION

Figure 1:
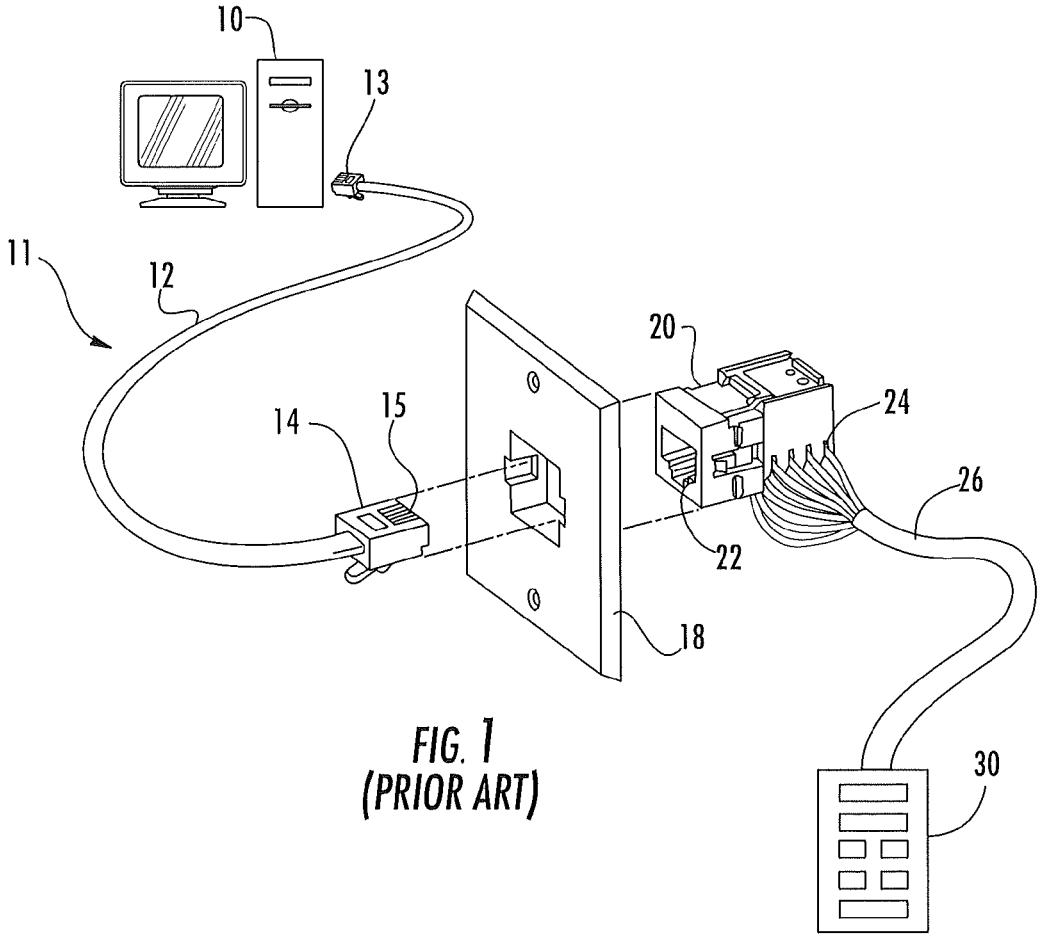
FIG. 1 (PRIOR ART)
FIG. 1 is a schematic drawing that illustrates the use of communications plug-jack connectors to connect a computer to a network device.

Pursuant to embodiments of the present invention, communications jacks are provided that include sliding contacts and/or contacts that include insulative base members. The jacks may comprise, for example, RJ-45 or RJ-11 jacks. Each contact is configured to move between a resting position and a deflected position. The contacts may be mounted above a main printed circuit board of the jack. In some embodiments, each contact may comprise an elongated insulative member that extends in the longitudinal direction of the jack. A conductive metal strip, pad or the like may be mounted on or near the front end of each elongated insulative member. One or more biasing members such as springs may be provided that bias the contacts toward their resting positions. The one or more springs need not be part of the communications paths through the communications jack. The contacts may slide, rotate or the like between their resting and deflected positions.

A plurality of contact pads (or other contact structures) may be provided on the top surface of the main printed circuit board of the communications jack. When a mating plug is received within a plug aperture of a communications jacks according to embodiments of the present invention, the contacts may be slidably or rotationally deflected by their corresponding plug blades into their respective deflected positions. In the deflected position, the metal strip or pad on each contact may mate with a respective one of a plurality of contact pads on the main printed circuit board of the communications jack. In this fashion, an electrical connection is provided between each plug blade and the main printed circuit board through the novel jack contacts according to embodiments of the present invention.

The communications jacks according to embodiments of the present invention may be designed to have very short current paths along the contacts thereof This may be made possible by, for example, the use of low profile contacts and/or by using contact pads that are located under the distal ends of the contacts to transfer signals between the contacts and the main printed circuit board. By shortening these current paths, it may be possible to reduce the amount of crosstalk between adjacent contacts. Additionally, by constructing part of each contact out of insulative materials it is also possible to further reduce crosstalk levels between adjacent contacts. Moreover, as the contacts may have a separate biasing member (e.g., a spring) that is not part of the current carrying path, stronger biasing members may be used without increasing crosstalk between adjacent contacts. Additionally, the jacks of the present invention may be less expensive to manufacture, and may have additional room on the main printed circuit board as, in some embodiments, there is no need for conductive vias for mounting conventional jackwire contacts thereon.

The present invention is directed to communications jacks and may be particularly well-suited for RJ-45 communications jacks. As used herein, the terms "forward" and "front" and derivatives thereof refer to the direction defined by a vector extending from the center of the jack toward the plug aperture of the jack. Conversely, the term "rearward" and derivatives thereof refer to the direction directly opposite the forward direction; the rearward direction is defined by a vector that extends away from the plug aperture toward the remainder of the jack. Together, the forward and rearward directions define the "longitudinal" dimension of the jack. The term "lateral" and derivatives thereof refer to the direction generally parallel with the line defined by the side of the plug aperture that includes a cutout for the latch of a mating plug and extending away from a plane that longitudinally bisects the center of the jack. The term "medial" and derivatives thereof refer to the direction that is the converse of the lateral direction. Together, the lateral and medial directions define the "transverse" dimension of the jack. A line normal to the longitudinal and transverse dimensions defines the "vertical" dimension of the jack.

Embodiments of the present invention will now be described with reference to the accompanying drawings, in which exemplary embodiments are shown.

Figure 3:
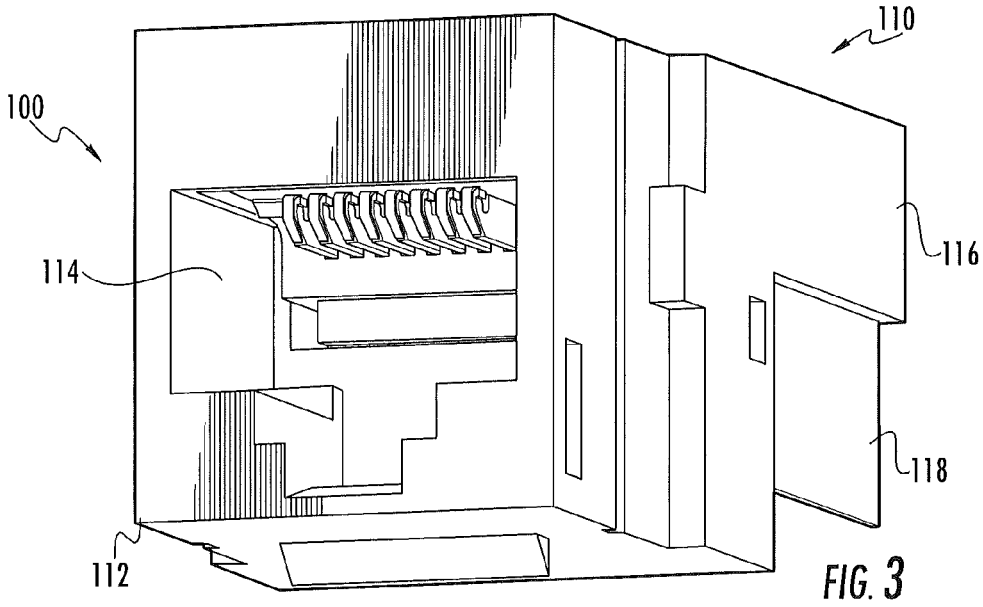
FIG. 3 is a schematic perspective view of a communications jack according to embodiments of the present invention.
Figure 4:
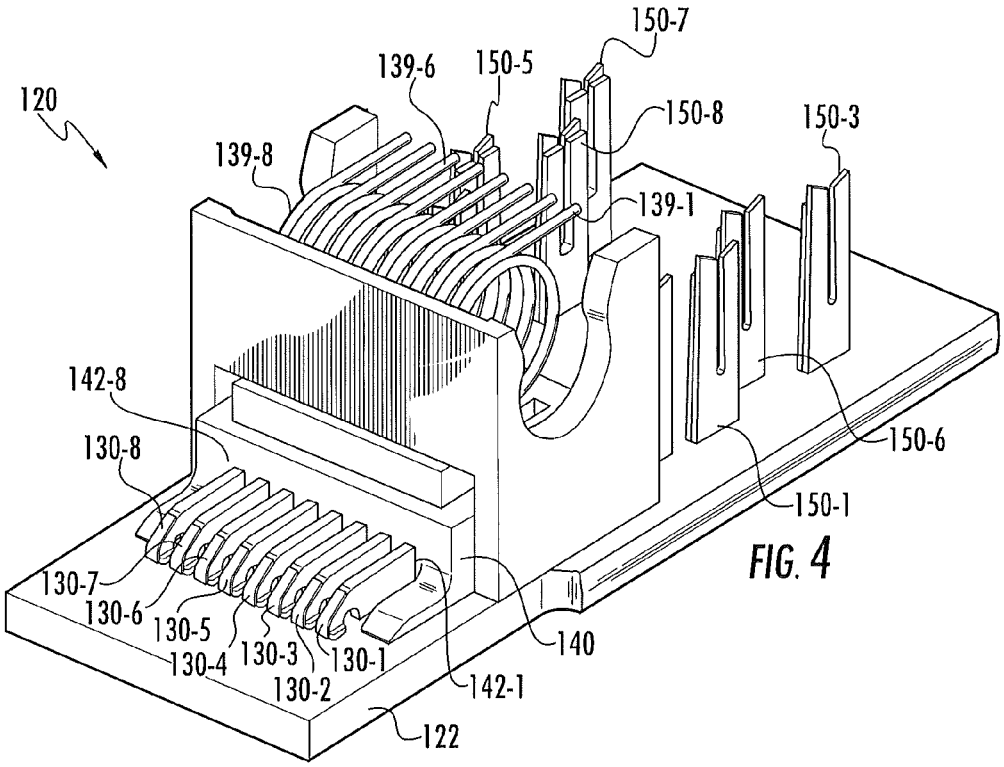
FIG. 4 is a schematic perspective view of the communications insert of the communications jack of FIG. 3.
Figure 5:
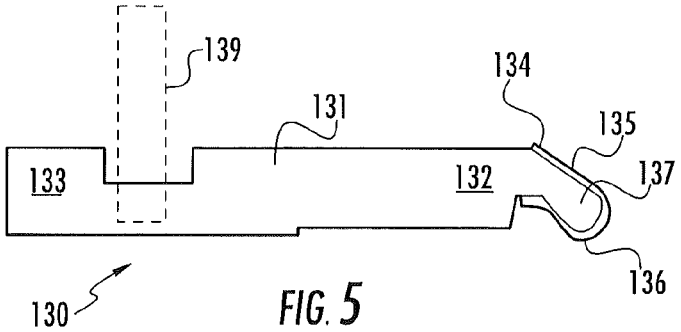
FIG. 5 is an enlarged side view of one of the sliding contacts of the communications jack of FIG. 3.
Figure 6:
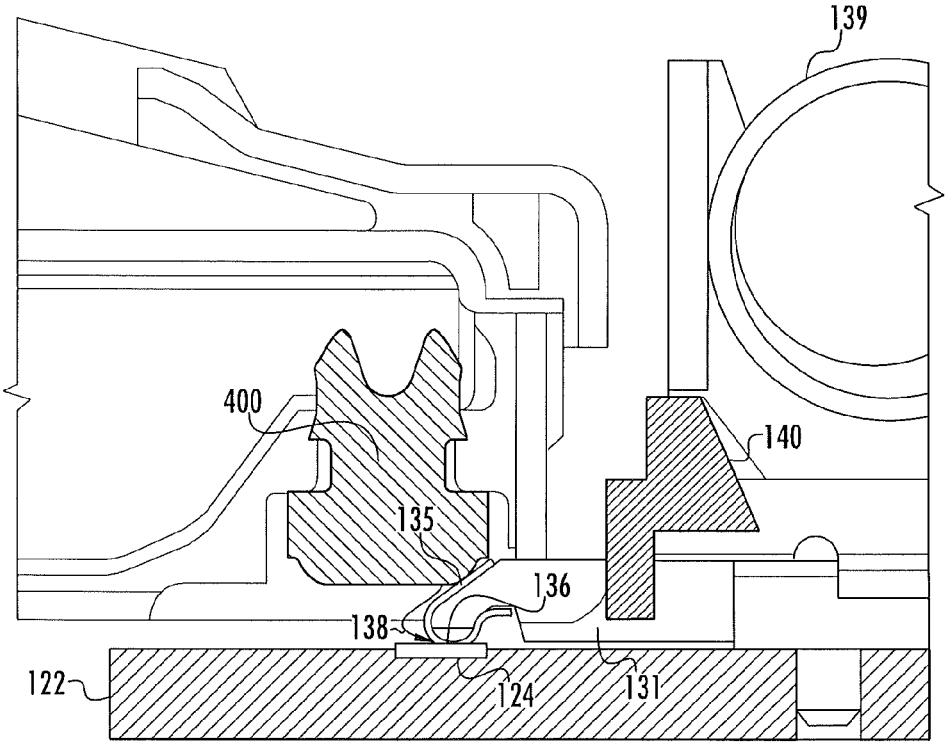
FIG. 6 is a schematic cross-sectional view that illustrates how the blade of a communications plug contacts one of the sliding contacts of the communications jack of FIG. 3 when a plug is inserted within the plug aperture thereof.
Figure 7:
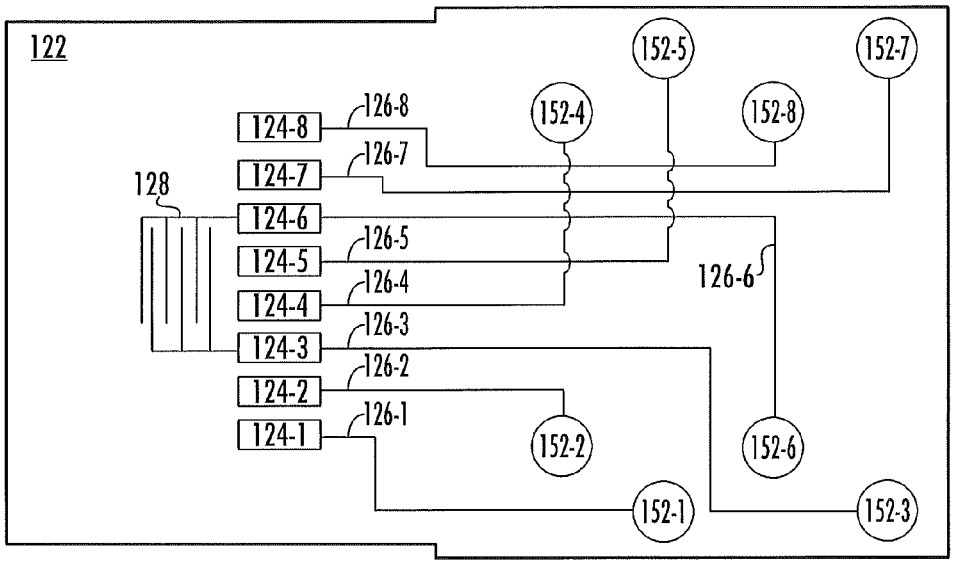
FIG. 7 is a schematic plan view of the printed circuit board of the communications jack of FIG. 3.
Figure 8:
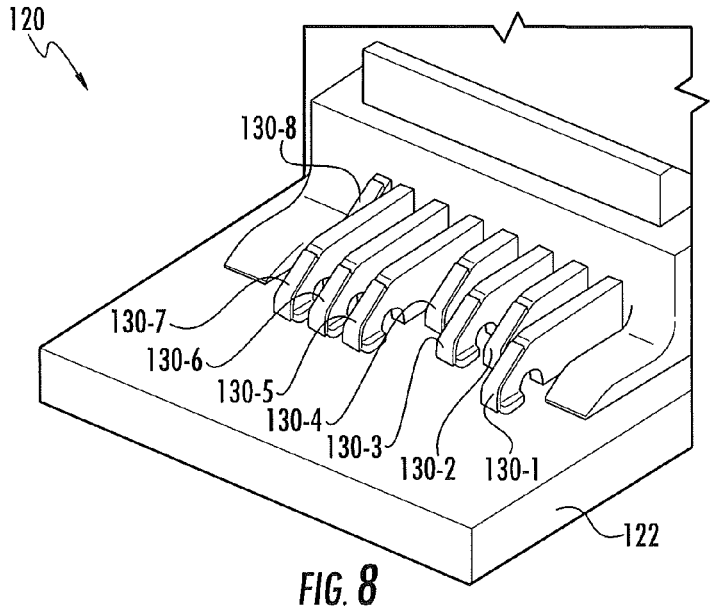
FIG. 8 is a schematic perspective view of the communications insert of the communications jack of FIG. 3 that graphically illustrates the different positions that can be assumed by the sliding contacts.

FIGS. 3-8 illustrate a communications jack 100 according to embodiments of the present invention that includes a plurality of partially insulative sliding contacts. In particular, FIG. 3 is a perspective view of the communications jack 100, and FIG. 4 is a perspective view of a communications insert 120 of the communications jack 100. FIG. 5 is an enlarged side view of one of the sliding contacts 130 of the communications jack 100. FIG. 6 is a schematic view that illustrates how the blade of a communications plug contacts one of the sliding contacts 130 of the communications jack 100 when a plug is inserted within the plug aperture thereof. FIG. 7 is a schematic plan view of a printed circuit board 122 of the communications jack 100. Finally, FIG. 8 is a schematic perspective view of the communications insert 120 of jack 100 that illustrates the different positions that the sliding contacts 130 may assume under different circumstances.

As shown in FIG. 3, the jack 100 includes a housing 110 that includes jack frame 112 having a plug aperture 114 for receiving a mating plug, a cover 116 and a terminal housing 118 (the terminal housing 118 is only partially shown in FIG. 3). These housing components 112, 116, 118 may be conventionally formed and not need be described in detail herein. Those skilled in this art will recognize that other configurations of jack frames, covers and terminal housings may also be employed with the present invention, and that the housing 110 may have more or less than three pieces. It will also be appreciated that the jack 100 is typically mounted in the orientation shown in FIG. 3. The communications insert 120 is shown in an inverted position in FIG. 4 to more clearly illustrate the components thereof. In the discussion that follows, the relationship of the components of jack 100 with respect to each other will be described with respect to the orientation of FIG. 4, as this view illustrates most of the components of jack 100. It will be appreciated, however, that in use the jack 100 will typically be rotated 180 degrees from the orientation shown in FIG. 4 to the orientation shown in FIG. 3.

Referring to FIGS. 3 and 4, it can be seen that the jack 100 includes a communications insert 120 that is received within an opening in the rear of the jack frame 112. The bottom of the communications insert 120 is protected by the cover 116 (see FIG. 3), and the top of the communications insert 120 is covered and protected by the terminal housing 118 (see FIG. 3). The communications insert 120 includes a printed circuit board 122, which in the illustrated embodiment is a substantially planar multi-layer printed wiring board. The printed circuit board 122 may comprise any conventional printed circuit board, a flexible printed circuit board or any other circuit structure that performs the functionality of the printed circuit board 122 that is described below.

Eight sliding contacts 130-1 through 130-8 are mounted in a row on a top surface of the printed circuit board 122. Herein, when the communications jacks according to embodiments of the present invention include multiple of the same components these components are referred to individually by their full reference numerals (e.g., contact 130-4) and are referred to collectively by the first part of their reference numeral (e.g., the contacts 130). The sliding contacts 130 are described in greater detail below. Eight output terminals 150 are also mounted on the printed circuit board 122. In this particular embodiment, the eight output terminals 150 are implemented as insulation displacement contacts (IDCs) that are inserted into eight respective IDC apertures 152-1 through 152-8 (see FIG. 6) in the printed circuit board 122. As is well known to those of skill in the art, an IDC is a type of wire connection terminal that may be used to make mechanical and electrical connection to an insulated wire conductor. The IDCs 150 may be of conventional construction and need not be described in detail herein.

The communications insert 120 further includes a contact guide structure 140. The contact guide structure 140 may be implemented, for example, as a piece of plastic that is mounted on a top surface of the printed circuit board 122. The contact guide structure 140 may have eight channels 142-1 through 142-8 therein, with each of these channels 142 extending in the longitudinal direction of the jack 100. Each of the sliding contacts 130 may be positioned to be received within a respective one of these channels 142. Each channel 142 may be configured to maintain the contacts 130 in their proper position in the transverse and vertical dimensions when a mating plug is received in the plug aperture 114 (or removed therefrom) to thereby cause the sliding contacts 130 to move in the longitudinal direction. In other words, in the embodiment of FIGS. 3-8, the contacts 130 may each slide in the longitudinal direction, but remain fixed in the transverse and vertical directions when a plug is received within the plug aperture and engages the sliding contacts 130.

A plurality of biasing members 139-1 through 139-8 may be mounted on the contact guide structure 140 (or, alternatively, in the printed circuit board 122 or the housing 110). Each biasing member 139 may be implemented, for example, using a spring. While in the depicted embodiment a total of eight springs 139-1 through 139-8 are provided, each of which is used to bias a respective one of the sliding contacts 130-1 through 130-8, it will be appreciated that in other embodiments fewer springs 139 could be used. As the springs 139-1 through 139-8 are not part of the current carrying paths, increased flexibility is provided regarding the material used to form the springs and the configurations of the springs. Consequently, it becomes possible to use, for example, very cheap, strong springs such as, for example, the simple coil steel springs illustrated in FIG. 4. In some embodiments, each spring 139-1 through 139-8 may be connected to a respective one of the sliding contacts 130-1 through 130-8. In other embodiments, the sliding contacts 130-1 through 130-8 are not connected to their respective springs 139-1 through 139-8, but instead directly or indirectly engage the springs 139-1 through 139-8 when a plug is received within the plug aperture 114. The springs 139-1 through 139-8 are configured to bias each of sliding contacts 130-1 through 130-8 in its resting position.

FIG. 5 is a side view of one of the sliding contacts 130. As shown in FIG. 5, the sliding contact 130 comprises an elongated insulative member 131 that has a front end 132 and a rear end 133. A conductive contact strip 134 is mounted on the front end 132 of the elongated insulative member 131. A spring 139 (which is partially shown in FIG. 5; see also FIG. 4) is connected, for example, to the rear end 133 of the sliding contact 130. The sliding contact 130 is slidably movable between a relaxed or "resting" position and a deflected position (see discussion of FIG. 8 herein). The spring 139 biases the sliding contact 130 toward its resting position.

As is further shown in FIG. 5, the conductive contact strip 134 conformally attaches to the front end 132 of the elongated insulative member 131. The conductive contact strip 134 may be formed of a resilient, highly conductive metal such as, for example, beryllium-copper or phosphor-bronze. In other embodiments, the conductive contact strip 134 may be formed of other conductive materials such as copper, copper alloys or plated (e.g., gold or nickel plated) copper or copper alloys. In some embodiments, the conductive contact strip 134 may snap into place on the front end 132 of the elongated insulative member 131. In other embodiments, the conductive contact strip 134 may be held in place by a retainment mechanism (not shown) or may be bonded or connected to the elongated insulative member 131 by any appropriate means. In still other embodiments, the conductive contact strip 134 may be insert-molded on an end of the elongated insulative member 131. The conductive contact strip 134 may, for example, have a length of about 122 mils (where the "length" refers to the distance from one end to the other end if the conductive contact element 134 were flattened into a planar element), a width of about 15 mils and a thickness of about 3 mils. Note that both the length and the thickness of the contact strip 134 may be considerably less than the length and the thickness of conventional spring jackwire contacts. This may advantageously reduce the amount of crosstalk between adjacent ones of the conductive contact strips 134.

Each of the sliding contacts 130 extends into the plug aperture 114 to form physical and electrical contact with the blades 400 of a mating plug (see FIG. 6). The conductive contact strip 134 of each sliding contact 130 includes a plug blade contact surface 135. As shown in FIG. 6, this plug blade contact surface 135 is the portion of the conductive contact strip 134 that will typically be engaged by the corresponding plug blade 400 of a communications plug that is received within the plug aperture 114 of communications jack 100. As can best be seen in FIG. 6, as a plug blade 400 is pushed into the plug aperture 114, it engages the plug blade contact surface 135 of its corresponding sliding contact 130 and thereby exerts both a rearward force and a downward vertical force on the sliding contact 130. The downward force exerted by the plug blade 400 forces the sliding contact 130 to come into contact with the top surface of the printed circuit board 122, and the rearward force exerted by the plug blade 400 forces the sliding contact 130 to slide rearwardly into its deflected position. As shown in FIG. 6, when the sliding contact 130 has been fully forced into its deflected position, a pad contact surface 136 of the conductive contact strip 134 comes into contact with a corresponding contact pad 124 that is provided on an upper surface of the printed circuit board 122. In this manner, the plug blade 400 is placed into electrical contact with the contact pad 124 via the conductive contact strip 134.

As shown best in FIGS. 5 and 6, the front end 132 of the elongated insulative member 131 is formed into a finger 137. The bottom surface of the finger 137 is at approximately the same height above the top surface of the printed circuit board 122 as is the rear end 133 of the elongated insulative member 131. The conductive contact strip 134 is designed to conformally fit onto the finger 137, and the interior cavity defined by the conductive contact strip 134 may be designed to be slightly smaller than the size of the finger 137 so that the resilient conductive contact strip 134 must be opened up and then slid or snapped onto the finger 137. In this fashion, the resilient nature of the metal used to form the conductive contact strip 134 (in embodiments that are implemented using such resilient metals) may hold the conductive contact strip 134 in place on the finger 137.

As best shown in FIGS. 5 and 6, the pad contact surface 136 of the conductive metal strip 134 extends below the lowermost point of the finger 137. As a result, when the pad contact surface 136 of the conductive contact strip 134 engages the top surface of the printed circuit board 122, the middle portion of the elongated insulative member 131 may be slightly displaced above the top surface of the printed circuit board 122. This design may help ensure that the pad contact surface 136 of the conductive contact strip 134 firmly engages its corresponding contact pad 124 on the printed circuit board 122 when the contact 130 is moved into its deflected position.

As is readily apparent from FIGS. 5 and 6, the current path through each of the sliding contacts 130 may be very short in length. This current path is illustrated by the arrow labeled 138 in FIG. 6, and extends from the plug blade contact surface 135 to the pad contact surface 136. In some embodiments, the length of the current path 138 through each of the sliding contacts 130 may be on the order of about 60 mils to about 70 mils, which is far less than the current path through most conventional spring jackwire contacts. As a result of this very short current path 138, it is possible to inject either capacitive and/or inductive crosstalk compensation on the printed circuit board 122 at a point that is very close in time to the plug-jack mating point, which may result in more effective crosstalk cancellation. Additionally, as is discussed above, the short length of the current path 138 also may advantageously reduce coupling, and hence crosstalk, between adjacent sliding contacts 130.

Figure 2:
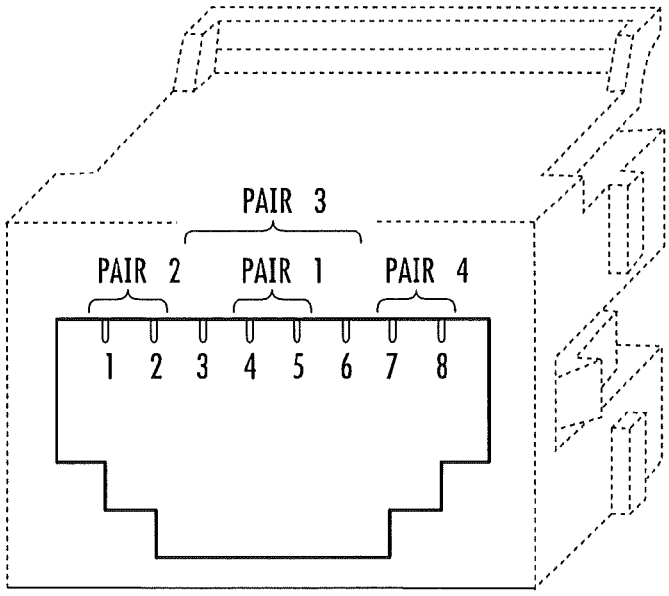
FIG. 2 (PRIOR ART)
FIG. 2 is a schematic diagram illustrating the modular jack contact wiring assignments for a conventional 8-position communications jack (TIA 568B) as viewed from the front opening of the jack.

Referring again to FIG. 4, it can be seen that the sliding contacts 130 are arranged in pairs defined by TIA 568B (see FIG. 2 and discussion thereof above). Accordingly, contacts 130-4, 130-5 (pair 1) are adjacent to each other and in the center of the row of contacts 130, contacts 130-1, 130-2 (pair 2) are adjacent to each other and occupy the rightmost two contact positions (from the vantage point of FIG. 4), contacts 130-7, 130-8 (pair 4) are adjacent to each other and occupy the leftmost two positions (from the vantage point of FIG. 4), and contacts 130-3, 130-6 (pair 3) are positioned between, respectively, pairs 1 and 2 and pairs 1 and 4. These contact positions are consistent with the contact positions depicted in FIG. 2, as the communications insert 120 is depicted in FIG. 4 in an inverted orientation.

FIG. 7 is a schematic plan view of the printed circuit board 122. As shown in FIG. 7, a plurality of metal-plated apertures 152-1 through 152-8 are provided that receive the eight respective IDCs 150-1 through 150-8. A plurality of contact pads 124-1 through 124-8 are also provided on the top surface of printed circuit board 122 towards the front end thereof. These contact pads 124 may each be implemented, for example, as a copper pad which may optionally include gold and/or nickel plating on a top surface thereof. Contact structures other than contact pads may alternatively be used. A plurality of conductive paths 126-1 through 126-8 are also provided. Each conductive path 126 connects a respective one of the contact pads 124 to its corresponding metal-plated aperture 152. Each conductive path 126 may be formed, for example, as a unitary conductive trace that resides on a single layer of the printed circuit board 122 or as two or more conductive traces that are provided on multiple layers of the printed circuit board 122 and which are electrically connected through metal-filled vias or other layer transferring techniques known to those of skill in the art. The conductive traces may be formed of conventional conductive materials such as, for example, copper, and are deposited on the printed circuit board 122 via any deposition method known to those skilled in this art. A plurality of crosstalk compensation circuits, return loss control circuits and the like 128 may also be provided on and/or within the printed circuit board 122. One exemplary crosstalk compensation circuit 128 is illustrated in FIG. 7. Additional disclosure regarding exemplary crosstalk compensation techniques is provided in the above-referenced '358 patent.

FIG. 8 is a perspective view of a portion of the communications insert 120 that illustrates the different positions that the sliding contacts 130 may take under different conditions. It will be appreciated that, in operation, every sliding contact 130 will typically be positioned the same distance from the front edge of the printed circuit board 122. The purpose of FIG. 8 is to comparatively show the different positions that the sliding contacts 130 may move to under different circumstances.

In particular, in FIG. 8, sliding contacts 130-1, 130-5, 130-6 and 130-7 are each shown in their normal resting positions (i.e., the position the contacts 130 assume when no plug is present in the plug aperture 114). Typically, the sliding contacts 130 will never be positioned any farther forwardly above the printed circuit board 122 than this resting position. In contrast, sliding contact 130-2 is positioned in what is considered a "nominal" or average deflected position (i.e., the position the contacts 130 will assume when a plug having the average dimensions specified in the relevant industry standards documents is present in the plug aperture 114). As is apparent, the deflected position is located rearward of the resting position. Sliding contacts 130-3 and 130-4 illustrate the minimum and maximum expected deflected positions given the tolerance range that is permitted for the housings and blades of industry standardized plug designs. The contact pads 124 on the printed circuit board 122 may be designed to ensure that good mechanical and electrical contact is achieved by each contact pad 124 and its corresponding sliding contact 130 when the sliding contacts 130 are in their deflected position for the full range of industry standard-compliant plugs. Finally, sliding contact 130-8 illustrates the position that sliding contacts 130-1 and 130-8 would assume if an RJ-11 plug was inadvertently inserted into the plug aperture 114.

In particular, in operation it is not all that uncommon for an RJ-11 communications plug to inadvertently be inserted into the plug aperture of an RJ-45 communications jack. In many conventional RJ-45 jacks, this may raise serious issues as the spring jackwire contacts of an RJ-45 jack can, in many instances, be permanently deformed when an RJ-11 plug is inserted in the plug aperture, as the jackwire contact designs that best reduce or minimize crosstalk between adjacent contacts also tend to be more susceptible to permanent deformation. In contrast, in the jack 100, strong springs 139-1 through 139-8 may be used that may easily absorb the increased force applied to the two outside contacts 130-1 and 130-8 if an RJ-11 plug is inadvertently inserted into the plug aperture 114, as is best illustrated in FIG. 8. In particular, while the housing of the RJ-11 plug will push the two outside contacts 130-1 and 130-8 farther rearwardly than would an RJ-45 plug, the springs 139-1 and 139-8 may readily be designed to deflect an additional distance associated with the further rearward movement of the sliding contacts 130-1 and 130-8 without resulting in any permanent deformation of the springs 139-1 and 139-8. Thus, the jack 100 may readily provide a solution to the "RJ-11 problem."

In the embodiment depicted in FIGS. 3-8, the jack 100 has crosstalk compensation circuits 128 that are located on the printed circuit board 122 (see FIG. 7). While this approach is simple to implement and may provide sufficient performance in many case (particularly given the short current path lengths through the sliding contacts 130), it has the disadvantage of not immediately starting to apply crosstalk compensation at the plug-jack mating point. Pursuant to further embodiments of the present invention, jacks are provided that inject crosstalk compensation at or almost at the plug-jack mating point, which may provide for improved crosstalk cancellation.

Figure 9:
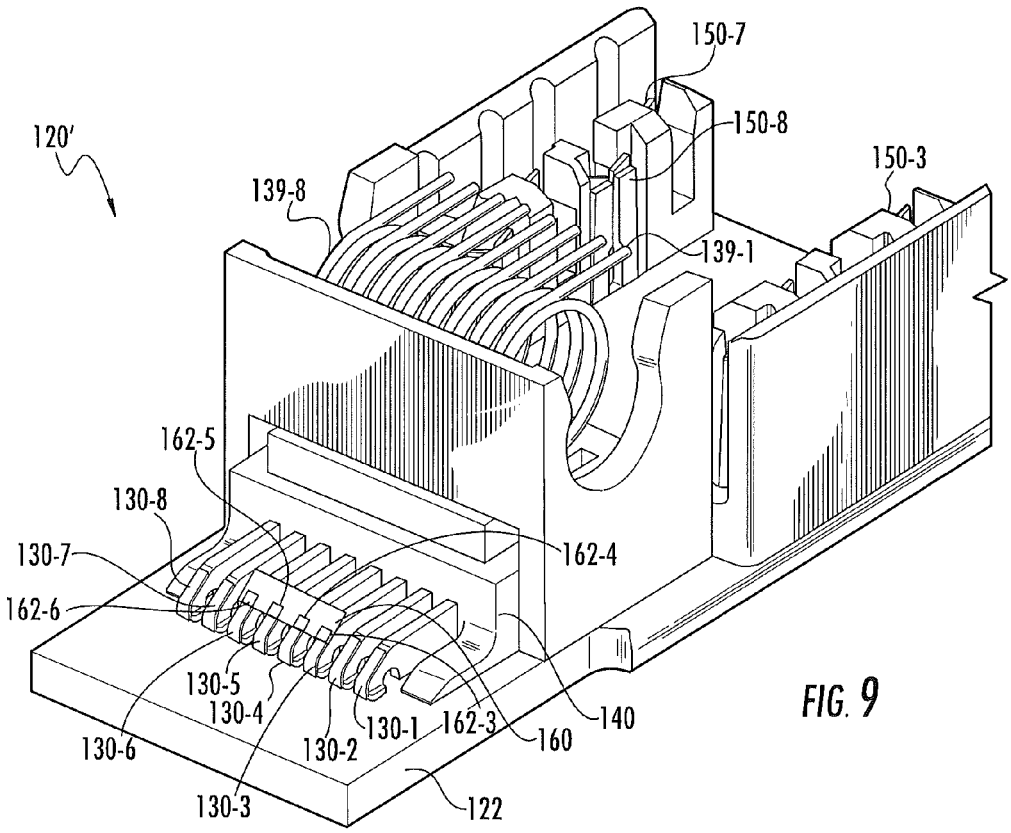
FIG. 9 is a schematic perspective view of a communications insert for a communications jack according to further embodiments of the present invention.

In particular, FIG. 9 is a schematic perspective view of a communications insert 120' according to further embodiments of the present invention. The communications insert

120' is very similar to the communications insert 120 of FIG. 4, except that the communications insert 120' further includes a flexible printed circuit board 160 that is mounted on sliding contacts 130-3 through 130-6. The flexible printed circuit board 160 includes four contacts 162-3 through 162-6 that are physically and electrically connected to contacts 130-3 through 130-6, respectively. Crosstalk compensation circuits (not shown in FIG. 9) such as, for example, capacitors between contacts 162-3 and 162-5 and between contacts 162-4 and 162-6 may be provided in or on the flexible printed circuit board 160. Notably as discussed above with respect to FIG. 6, the current path 138 through each sliding contact 130 runs from the plug blade contact surface 135 to the pad contact surface 136. Each contact 162-3 through 162-6 contacts the conductive contact strip 134 of its respective contact 130-3 through 130-6 outside of the current path 138. As a result, the crosstalk compensation circuits included on flexible printed circuit board 160 will be at almost a zero delay from the plug blades 400 as they are located on conductive dead end stubs that only carry small amounts of current (namely the currents drawn through the capacitors). Such a design may provide improved crosstalk cancellation.

Figure 10:
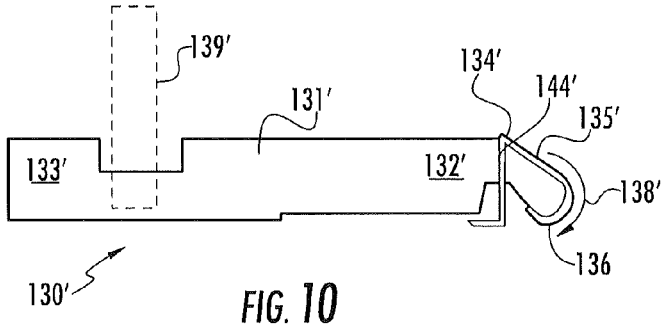
FIG. 10 is a side view of a sliding contact for a communications jack according to further embodiments of the present invention.

FIG. 10 is a side view of a sliding contact 130' that may alternatively be used in the jacks according to embodiments of the present invention to inject crosstalk compensation very close in time to the plug-jack mating point. In particular, as shown in FIG. 10, the sliding contact 130' is almost identical to the sliding contact 130 of FIG. 5. In particular, the sliding contact 130' includes an elongated insulative member 131', a conductive contact strip 134' that has a plug blade contact surface 135' and a pad contact surface 136'. The contact 130' is biased by a spring 139' to be slidably movable between a resting position and a deflected position.

In addition, the conductive contact strip 134' of sliding contact 130' further includes a downwardly extending L-shaped member 144'. The bottom portion of the L-shaped member 144' mates with a second contact pad 129' that is provided rearwardly of the contact pad 124' on the upper surface of the printed circuit board 122'. Thus, both ends of the conductive contact strip 134' make electrical contact with the printed circuit board 122'. As shown in FIG. 10, when a plug is received within the plug aperture of a jack that includes the contacts 130', the plug blade 400 contacts the plug blade contact surface 135' of the conductive contact strip 134'. The signal current carrying path 138' from the plug blade 400 to the contact pad 124' is illustrated in FIG. 10 by the arrow 138'. The remainder of the conductive contact strip 134' comprises a dead-end stub that is generally not part of the signal current carrying path. A crosstalk compensation circuit 128' such as, for example, a capacitor may be provided on the printed circuit board 122' and connected to the contact pad 129'. This crosstalk compensation capacitor 128' may be connected, for example, between the contact pads 129' for two non-adjacent contacts (e.g., contacts 130-3 and 130-5 or contacts 130-4 and 130-6). Since the crosstalk compensation circuit 128' is connected to the non-signal current carrying portion of the conductive contact strip 134', the crosstalk compensation injected by the crosstalk compensation circuit 128' will be very close in time to the plug-jack mating point. As noted above, such crosstalk compensation may more fully cancel out offending crosstalk that is generated in the plug and the plug-jack mating region.

FIGS. 11A-11E illustrate additional spring designs that may be used in communications jacks according to embodiments of the present invention.

Figure 11A:
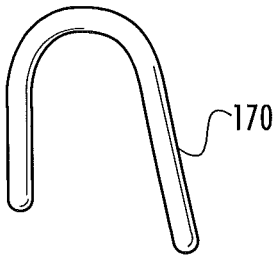
FIGS. 11A-11E are side views of a variety of springs that can be used in the communications jacks according to embodiments of the present invention.

In particular, FIG. 11A illustrates a simple U-shaped spring 170. Eight of the springs 170 could be used to replace the eight coiled springs 139-1 through 139-8 that are illustrated in FIG. 4. The U-shaped springs 170 may provide less force as compared to a similarly sized coiled spring, but may be cheaper to manufacture.

Figure 11B:
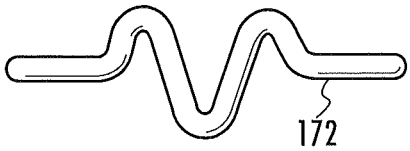

FIG. 11B illustrates a stamped sinuous compression spring 172. Eight of the springs 172 could be used to replace the eight coiled springs 139-1 through 139-8 that are illustrated in FIG. 4.

Figure 11C:
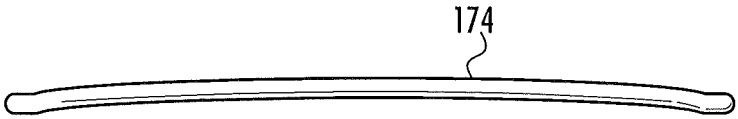

FIG. 11C illustrates another spring that is in the form of a long, bowed stamped beam 174. Eight of the springs 174 could be used to replace the eight coiled springs 139-1 through 139-8 that are illustrated in FIG. 4. Due to their extended length, the springs 174 would extend further rearwardly in the jack 100 so that a portion of each spring 174 would be between the IDCs 150.

Figure 11D:
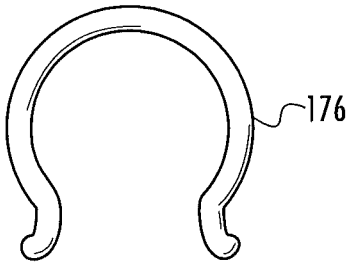

FIG. 11D illustrates a horseshoe shaped spring 176. Eight of the springs 176 could be used to replace the eight coiled springs 139-1 through 139-8 that are illustrated in FIG. 4.

Figure 11E:
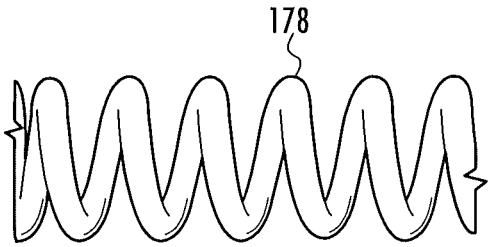

FIG. 11E illustrates a helical spring 178 that extends in the longitudinal direction of the jack. Eight of the springs 178 could be used to replace the eight coiled springs 139-1 through 139-8 that are illustrated in FIG. 4.

Figure 12:
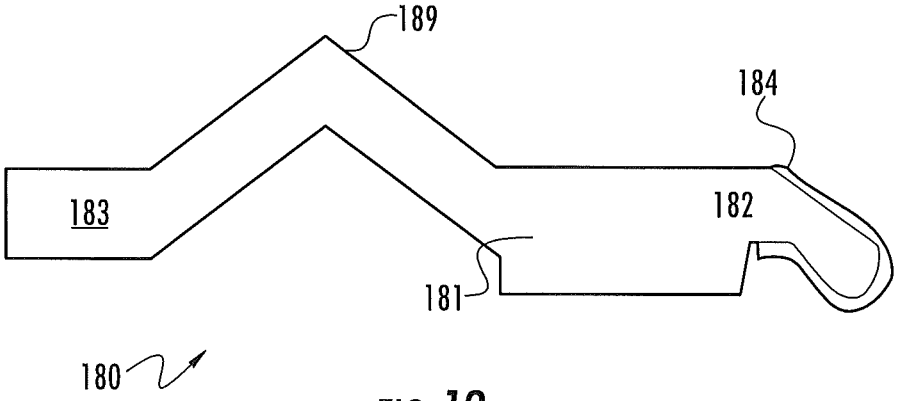
FIG. 12 is a side view of a sliding contact for a communications jack according to still further embodiments of the present invention that includes an integrated biasing member.

It will likewise be appreciated that according to further embodiments of the present invention, contacts for a communications jack are provided that integrate the spring into the insulative base of the contact. For example, FIG. 12 illustrates a jack contact 180 according to embodiments of the present invention that includes an insulative base 181 that has a front end 182 and a rear end 183. A conductive contact strip 184 is mounted on the front end 182 of the insulative base 181. A portion 189 of the insulative base 181 is formed into a biasing member. In the embodiment shown, the portion 189 is formed into a living hinge that contracts when a plug blade 400 pushes the contact 180 rearwardly and which expands when the plug blade 400 is removed. It will be appreciated that the biasing member 189 may take on a wide variety of different shapes or forms.

Figure 13:
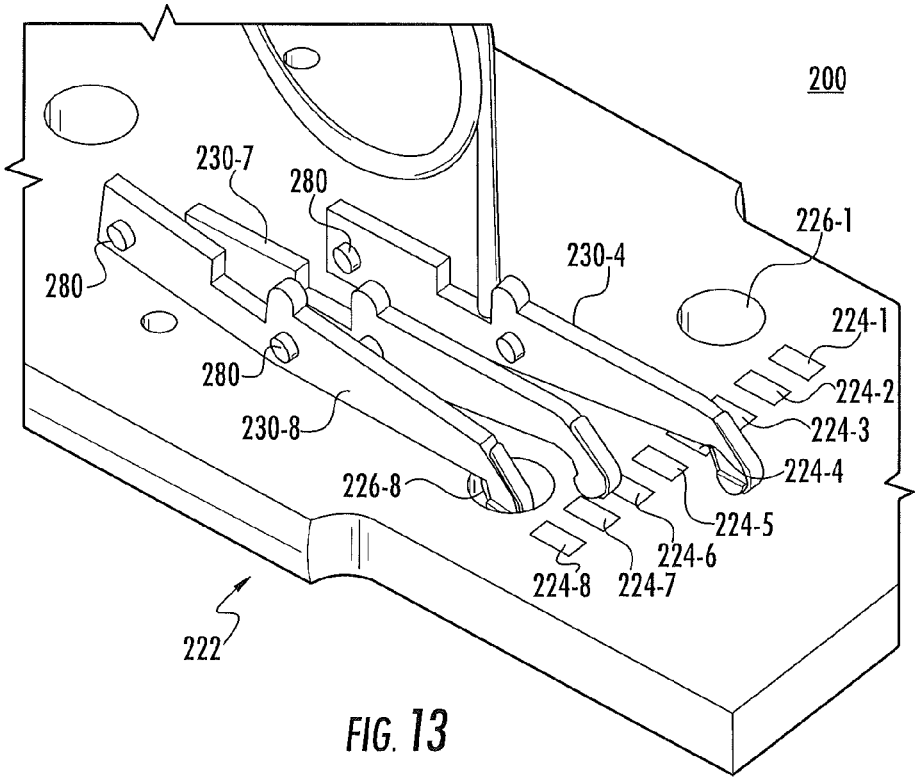
FIG. 13 is a schematic perspective view of a communications insert for a communications jack according to still further embodiments of the present invention.

FIG. 13 illustrates portions of the communications insert 220 of a jack 200 according to further embodiments of the present invention. The communications insert 220 includes a printed circuit board 222 that has eight contact pads 224-1 through 224-8 thereon, eight contacts 230-1 through 230-8 and eight springs 239-1 through 239-8 (only spring 239-4 and contacts 230-4, 230-7 and 230-8 are pictured in FIG. 13 to simplify the drawing). It will be appreciated that the jack 200 will include IDCs, a contact guide structure and a housing which may be identical to the IDCs 150, the contact guide structure 140 and the housing 110 of the jack 100 of FIGS. 3-8. The jack 200 includes an additional feature that may be used to solve the RJ-11 problem in a different way.

In particular, the printed circuit board 222 includes a pair of apertures 226-1 and 226-8 that are located rearward of the contact pads 224-1 through 224-8. The aperture 226-1 is longitudinally aligned with the sliding contact 330-1 (which is not shown in FIG. 13), and the aperture 226-8 is longitudinally aligned with the sliding contact 230-8. When an RJ-45 communications plug is received within the plug aperture of jack 200, the sliding contacts 230-1 through 230-8 are forced backward by the plug from their resting position (which is the position of sliding contact 230-4 in FIG. 13) to their deflected position (which is the position of sliding contact 230-7 in FIG. 13). As shown in FIG. 13, when the sliding contacts 230 are in their deflected position, the forward end of each contact 230 is still positioned forwardly of the apertures 226-1, 226-8. As such, the apertures 226-1 and 226-8 have no impact on the contacts 230.

In contrast, when an RJ-11 communications plug is received within the plug aperture of jack 200, the contacts 230-2 through 230-7 are forced backward by the plug from their resting position (which is the position of contact 230-4 in FIG. 13) to their deflected position (which is the position of sliding contact 230-7 in FIG. 13). However, the housing of the RJ-11 communications plug forces the sliding contacts 230-1 and 230-8 backward even further to the position of sliding contact 230-8 in FIG. 13). As shown in FIG. 13, when this occurs, the forward portion of sliding contact 230-8 falls into the aperture 226-8, which may reduce the additional distance (if any) that the housing of the RJ-11 plug pushes the sliding contact 230-8 rearwardly. As such, the spring 230-8 is not over-deflected if an RJ-11 plug is mistakenly inserted in the plug 200. The same effect will occur with the forward portion of sliding contact 230-1 (not shown) and the aperture 226-1. By providing the apertures 226-1 and 226-8, the rearward motion of the sliding contacts 230-1 through 230-8 may be limited so that the forward edge of the sliding contacts 230-1 through 230-8 will not travel rearwardly past the apertures 226-1, 226-8. As a result, simpler springs 239-1 and 239-8 that absorb less force (without permanent deformation) may be used. The apertures 226-1, 226-8 ensure that neither the sliding contacts 230-1, 230-8 or their corresponding springs 239-1, 239-8 will be damaged if an RJ-11 communications plug is inadvertently inserted within the jack 200.

As is also shown in FIG. 13, the contacts 230-1 and 230-8 have round protrusions 280 (these protrusions could have other shapes) on the sidewalls of the elongated insulative member 231 that act in conjunction with tracks that are provided in the walls of the channels 142 in the contact guide structure 240 (not shown in FIG. 13, but see corresponding structure in FIG. 4) as cam followers. When an RJ-11 plug that has forced the contacts 230-1 and 230-8 into the respective apertures 226-1 and 226-8 is removed from the plug aperture of jack 200, the springs 239-1 and 239-8 force the respective contacts 230-1 and 230-8 forwardly, and the movement of the protrusions 280 along the tracks (not shown) in the channels 142 of the contact guide structure 140 lift the contacts 230-1 and 230-8 out of their respective holes 226-1 and 226-8 so that the front end of each sliding contact 230-1, 230-8 is on (or above) the top surface of the printed circuit board 222. The protrusions 280 may also be designed to lift the front end of the contacts 230-1 and 230-8 slightly off the top surface of the printed circuit board 222 so that a wiping action will occur between the contacts 230 and their respective contact pads 224 on the printed circuit board 222. This wiping action may facilitate a better electrical connection between the contacts 230 and their respective contact pads 224. It will be appreciated that protrusions 280 may be provided on all of the contacts 230-1 through 230-8 and associated tracks may be provided in the channels 142 for each of the sliding contacts 230. Likewise, the protrusions 280 and tracks may also be provided on the sliding contacts 130 and in the channels 142, respectively in the jack 100 of FIGS. 3-8.

Figure 14:
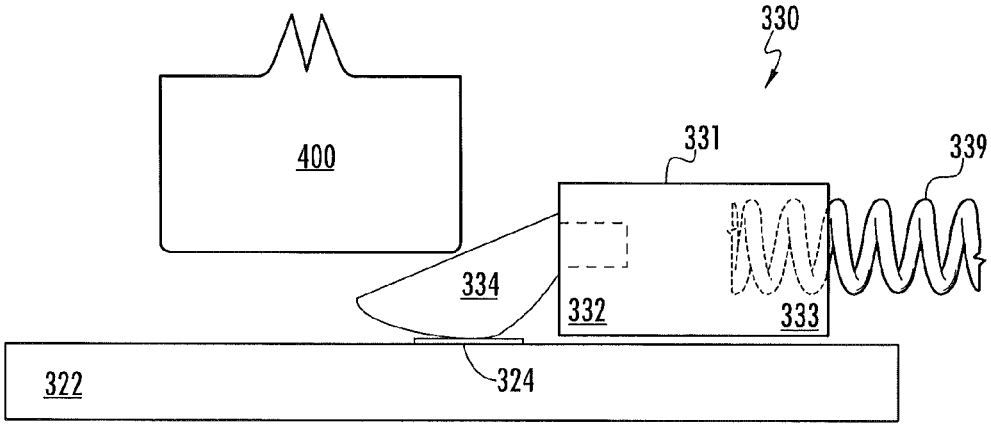
FIG. 14 is a side view of a sliding contact for a communications jack according to further embodiments of the present invention.

FIG. 14 is a schematic cross-sectional view of a sliding contact 330 according to further embodiments of the present invention that is mounted on a printed circuit board 322. As shown in FIG. 14, the sliding contact 330 comprises an insulative member 331 that has a front end 332 and a rear end 333. A metal contact 334 is mounted on the front end 332 of the insulative member 331. The metal contact 334 may comprise, for example, a wedge shaped metal contact that is mounted in an aperture in the front end 332 of the insulative member 331. A coiled spring 339 is connected to the rear end 333 of the sliding contact 330. The sliding contact 330 is slidably movable between a resting position and a deflected position (the contact is shown in its deflected position). The spring 339 biases the sliding contact 330 toward its resting position.

As is further shown in FIG. 14, a contact pad 324 is provided on an upper surface of the printed circuit board 322. When a plug is inserted in the plug aperture of a communications jack that includes the sliding contact 330, the plug blade 400 pushes the contact 330 rearwardly (which is to the right in FIG. 14) so that the metal contact 334 rests on top of the contact pad 324. The plug blade 400 exerts both a rearward and a downward force on the contact 330 so that the contact 330 firmly rests on the contact pad 324 (thereby providing a good mechanical and electrical connection) once the plug is fully inserted within the plug aperture.

Figure 15:
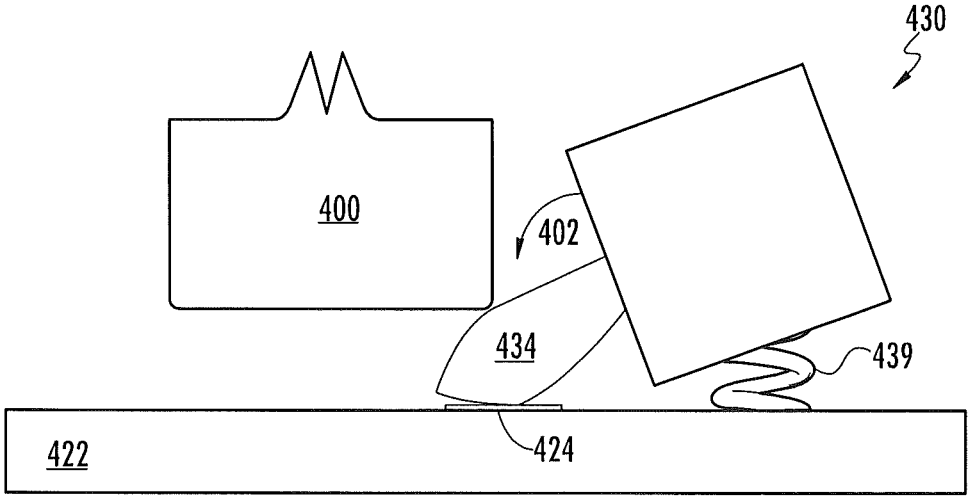
FIG. 15 is a side view of a rotating contact for a communications jack according to embodiments of the present invention.

While embodiments of the present invention have primarily been discussed herein with respect to jack contacts that slide back and forth in the longitudinal direction of the jack, it will be appreciated that various modifications may be made to these contacts. By way of example, in other embodiments the contacts may not slide in a perfectly linear fashion, but instead may slide through, for example, an arc or other nonlinear path. As another example, FIG. 15 illustrates a contact 430 according to further embodiments of the present invention. The contact 430 is very similar to the contact 330 of FIG. 12, except that the contact 430 rotates downward to come into contact with a corresponding contact pad 424 on a printed circuit board 422 when the contact 430 is engaged by the blade 400 of a plug is inserted within a plug aperture of a jack that includes such a contact 430. The arrow labeled 402 illustrates the rotation of the contact 430 in response to the plug blade 400 (note that the contact 430 is pictured in its deflected position).

Figure 16:
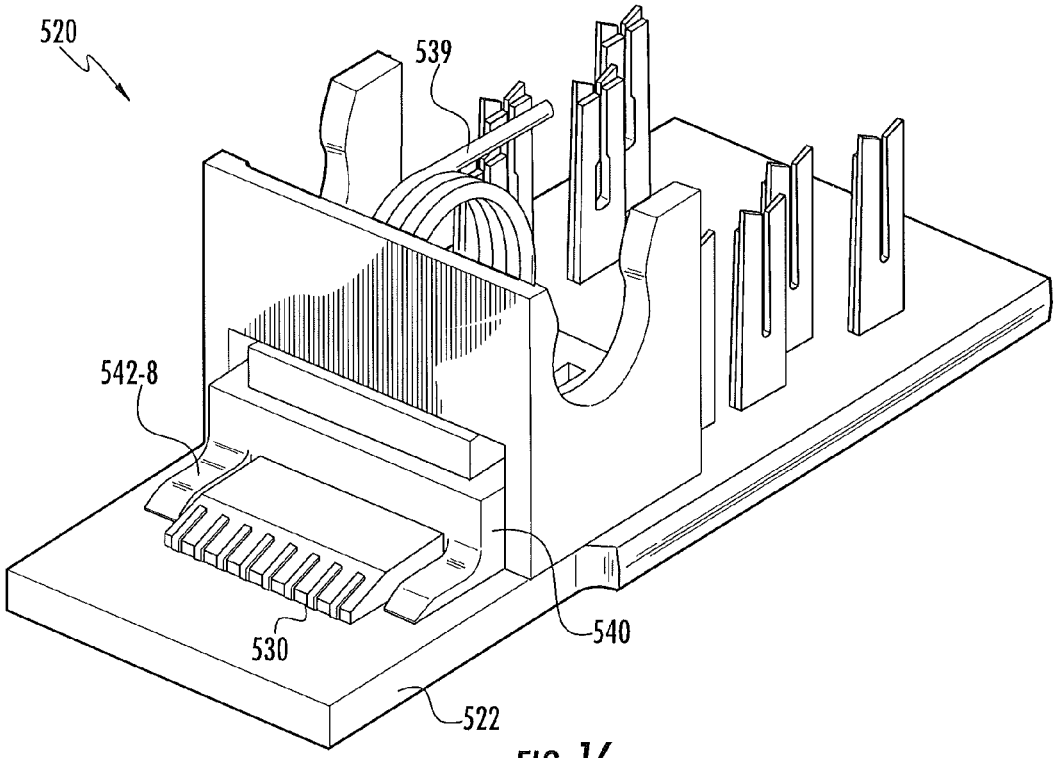
FIG. 16 is a perspective view of a communications insert for a communications jack that includes a single moving contact element.

Pursuant to still further embodiments of the present invention, communications jacks are provided that have a plurality of contacts that are mounted on a common insulative base. FIG. 16 is a schematic perspective view of a communications insert 520 for a communications jack that includes such a common contact base. As shown in FIG. 16, the communications insert 520 is similar to the communications insert 120 of FIG. 4, except that the eight individual contacts 130 of the communications insert 120 are replaced with a common substrate 530 that has eight conductive contact strips 534 mounted thereon. The substrate 530 is mounted within a channel 542 in a contact guide structure 540. The substrate 530 is biased into a resting position by a biasing member 539 which may, for example, comprise a spring. The substrate 530 may be mounted to slide between the resting position and a deflected position when a plug is received in the plug aperture of a jack that includes the communications insert 520.

In some embodiments, the substrate 530 may be a fully insulative member such as, for example, a plastic block. In other embodiments, the substrate 530 may comprise, for example, a printed circuit board that may, for example, include crosstalk compensation circuits. It will be appreciated that in some embodiments, considerations such as, for example, industry specified tolerances, may make it desirable or necessary to provide an individual spring for each contact. Thus, the use of a common insulative base may not be appropriate or desirable in such circumstances.

The contacts according to embodiments of the present invention may exhibit a number of advantages as compared to conventional jackwire contacts. As known to those of skill in the art, the jackwire contacts that are used in almost all conventional RJ-45 jacks comprise elongated spring contacts that are formed of a resilient metal and are mounted in a cantilevered fashion to extend into the plug aperture of the jack. These contacts mate with the respecting blades of a communications plug and, since they are formed of a conductive metal, carry the signal from each plug blade to a printed circuit board of the jack (or, in some cases, directly to corresponding output contacts of the jack). The resiliency of the metal is used to provide the contact force that makes a good mechanical and electrical connection between each jackwire contact and its corresponding plug blade.

However, conventional jackwire contacts typically must be fairly long in order to ensure that the resiliency of the metal provides sufficient contact force. As a result, the coupling between adjacent contacts is increased. Additionally, conventional jackwire contacts can be very susceptible to permanent deformation as the contacts tend to be very thin and are cantilevered such that they can be inadvertently bent in the wrong direction and deformed. In contrast, since the contacts according to embodiments of the present invention use a separate spring that is not part of the communications path, the conductive portion of the contact may be made to be very small, thereby reducing the coupling between adjacent contacts. Additionally, much stronger spring designs may be used (e.g., coiled springs as opposed to cantilevered resilient beams) that may better resist permanent deformation. The contacts according to embodiments of the present invention may include an elongated insulative member that provides a sturdy contact without increasing coupling between adjacent contacts.

As discussed above, the communications jacks according to embodiments of the present invention may have contacts that have insulative base members. These insulative base members may move (e.g., slide, rotate) in response to a plug that is inserted into a plug aperture of a jack that includes these contacts. As discussed above, by making a portion of the contacts insulative, the overall coupling between adjacent contacts may be reduced. Additionally, since coupling is not an issue with the insulative base members, thicker and/or sturdier contacts may be used. The use of insulative (e.g., plastic) base members also allows injection molding of the contacts, which allows for complex contact designs to be cheaply and readily fabricated. Thus, the use of contacts with insulative base members may provide a number of advantages over conventional contacts.

It will likewise be appreciated that the jack contacts according to certain embodiments of the present invention may be non-cantilevered contacts such as, for example sliding contacts.

Referring again to FIG. 6, it will be understood that the contacts according to embodiments of the present invention (e.g., contact 130) may be designed so that they will not be in either physical or electrical contact with the contact pad (e.g., contact 124) on the printed circuit board (e.g., printed circuit board 122) when no plug is received within the plug aperture of the jack. This lack of an electrical connection can be ensured by, for example, configuring the conductive contact strips 134 of the contacts 130 so that they will be positioned above the printed circuit board when no plug is received within the plug aperture and/or by positioning the contact pad 124 so that it is located rearwardly of the conductive contact strip 134 when the contact 130 is in its resting position.

As noted above, in some embodiments, the contacts 130 may be configured so that the conductive contact strips 134 thereof will be positioned above the printed circuit board 122 when no plug is received within the plug aperture of the jack. When a plug is inserted into the plug aperture, it pushes each of the contacts 130 both rearwardly and downwardly so that each contact 130 comes into physical and electrical contact with its respective contact pad 124 on the printed circuit board 122 (see FIG. 6). One advantage of this design is that a "wiping" action occurs between the conductive contact strip 134 of each contact 130 and its respective contact pad 124. Such a wiping action may ensure a better electrical connection between each conductive contact strip 134 and its respective contact pad 124.

While embodiments of the present invention have primarily been discussed herein with respect to communications jacks that include eight conductive paths that are arranged as four differential pairs of conductive paths, it will be appreciated that the concepts described herein are equally applicable to jacks that include other numbers of differential pairs. It will also be appreciated that communications cables and connectors may sometimes include additional conductive paths that are used for other purposes such as, for example, providing intelligent patching capabilities. The concepts described herein are equally applicable for use with such communications cables and connectors, and the addition of one or more conductive paths for providing such intelligent patching capabilities or other functionality does not take such cables and connectors outside of the scope of the present invention or the claims appended hereto.

While the present invention has been described above primarily with reference to the accompanying drawings, it will be appreciated that the invention is not limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Spatially relative terms, such as "under", "below", "lower", "over", "upper", "top", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, operations, elements, and/or components, but do not preclude the presence or addition of one or more other features, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Herein, the terms "attached", "connected", "interconnected", "contacting", "mounted" and the like can mean either direct or indirect attachment or contact between elements, unless stated otherwise.

Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A communications jack, comprising:

a plurality of sliding contacts that each include an electrically conductive contact surface, wherein each of the plurality of sliding contacts is configured to slidably move between a resting position and a deflected position;

at least one biasing member that is separate from the plurality of sliding contacts and that is electrically insulated from the conductive contact surfaces of the plurality of sliding contacts, the at least one biasing member configured to bias at least a first of the plurality of sliding contacts towards its resting position; and a printed circuit board that includes a first contact structure that is configured to electrically connect to the first of the plurality of sliding contacts when the first of the plurality of sliding contacts is in its deflected position, wherein the first contact structure comprises a first contact pad, and wherein the first of the plurality of contacts physically engages the first contact pad when the first of the plurality of contacts is in its deflected position.

2. The communications jack of claim 1, wherein the communications jack is an RJ-45 jack that has a housing having a plug aperture, wherein the plurality of contacts are located within the plug aperture, and wherein the plurality of sliding contacts comprises eight sliding contacts that are arranged as four differential pairs of sliding contacts and that are each configured to slidably move along the top surface of the printed circuit board.

3. The communications jack of claim 1, wherein the at least one biasing member comprises a plurality of springs, and wherein each of the plurality of springs is configured to bias a respective one of the plurality of sliding contacts towards its resting position.

4. The communications jack of claim 1, wherein each of the plurality of sliding contacts comprises an elongated insulative structure that has a conductive element that includes the conductive contact surface mounted thereon.

5. The communications jack of claim 4, wherein the conductive element comprises a metal strip that is insert-molded on an end of the elongated insulative structure.

6. The communications jack of claim 1, wherein the communications jack is configured so that the first of the plurality of sliding contacts is wedged between a plug blade of a mating plug and the first contact pad when the plug is fully received within a plug aperture of the communications jack.

7. An RJ-45 jack, comprising:

a housing having a plug aperture that is sized to receive an RJ-45 plug;

a printed circuit board having a first contact pad thereon;

first through eighth sliding contacts that extend into the plug aperture, the first through eighth sliding contacts arranged as four differential pairs of sliding contacts;

wherein each of the first through eighth sliding contacts is configured to slide along a direction of a plug insertion axis of the communications jack from a respective resting position above the printed circuit board to a respective deflected position above the printed circuit board when the RJ-45 plug is received within the plug aperture, wherein the first sliding contact physically engages the first contact pad when the first sliding contact is in its deflected position.

8. The RJ-45 jack of claim 7, wherein each of the first through eighth sliding contacts is a spring-biased contact.

9. The RJ-45 jack of claim 7, wherein each of the first through eighth sliding contacts comprises an elongated insulative structure that has a conductive element mounted thereon.

10. The RJ-45 jack of claim 9, further comprising a plurality of contact pads on the printed circuit board, wherein each of the contact pads is positioned to be under the conductive element of a respective one of the first through eighth sliding contacts when the first through eighth sliding contacts are in their deflected positions.

11. The RJ-45 jack of claim 9, wherein the conductive element of at least one of the first through eighth sliding contacts extends along a portion of the bottom of the elongated insulative structure and around a front portion of the elongated insulative structure.

12. A contact for an RJ-45 jack, comprising:

an elongated insulative member that is configured to move between a forward position and a rearward position;

an electrically conductive contact structure mounted on the elongated insulative member such that the electrically conductive contact structure moves together with the elongated insulative member between the resting position and the deflected position; and a biasing member that is separate from the insulative member that biases the insulative member toward the forward position, wherein the elongated insulative member is longer than the electrically conductive contact structure.

13. The contact of claim 12, wherein the electrically conductive contact structure comprises a metal strip that is conformally mounted on a first end of the insulative member.

14. The contact of claim 12, wherein the electrically conductive contact structure is formed of a resilient metal and is resiliently mounted on a first end of the insulative member.

15. The contact of claim 12, in combination with a communications jack that includes a printed circuit board.

16. The contact of claim 15, wherein the contact includes a pad contact surface that is configured to mate with a surface contact pad that is provided on a top surface of the printed circuit board.

17. The contact of claim 15, wherein the contact is configured to slidably move from a resting position to a deflected position in response to a plug being inserted into a plug aperture of the communications jack.

18. A contact for a communications jack, comprising:

an insulative member;

a conductive member mounted on the insulative member, the conductive member having a plug blade contact surface that is conformally mounted on the insulative member; and a biasing member that is connected to the insulative member;

wherein the conductive contact member and the insulative member are configured to move together as a single structure between a resting position and a deflected position, and wherein the biasing member biases the conductive contact member and the insulative member toward the resting position;

wherein the conductive member comprises a metal strip mounted on the insulative member.

* * * * *